United States Patent [19]

Abernathy, Jr. et al.

[11] 4,345,896

[45] Aug. 24, 1982

[54] METHODS AND APPARATUS FOR CALCINING CARBONACEOUS MATERIAL

[75] Inventors: Randolph Abernathy, Jr., South Orange; Douglas M. Rowe, Somerset, both of N.J.

[73] Assignee: Airco, Inc., Montvale, N.J.

[21] Appl. No.: 258,826

[22] Filed: Apr. 29, 1981

[51] Int. Cl.[3] ..... F27D 7/02; F27B 9/04; F27B 7/00

[52] U.S. Cl. ..... 432/19; 201/36; 202/100; 202/131; 202/216; 432/23; 432/103; 432/117

[58] Field of Search ..... 432/19, 23, 105, 103, 432/117, 200, 13; 201/27, 32, 36, 37; 202/100, 131, 216

[56] References Cited

U.S. PATENT DOCUMENTS

| | | | |
|---|---|---|---|
| 3,182,980 | 5/1965 | Helfrich | 432/117 |
| 4,209,292 | 6/1980 | Rossi | 432/105 |
| 4,266,931 | 5/1981 | Struckmann | 432/113 |

FOREIGN PATENT DOCUMENTS

| | | | |
|---|---|---|---|
| 1195560 | 6/1970 | United Kingdom | 432/19 |

*Primary Examiner*—John J. Camey
*Attorney, Agent, or Firm*—David L. Rae; Larry R. Cassett

[57] ABSTRACT

The rate of calcining carbonaceous material in a rotary kiln is increased by introducing oxygen into the inlet of air fans mounted on the kiln. The introduction of oxygen is effected during a predetermined portion of each kiln revolution and is effective to enrich the oxygen content of air supplied to the kiln to approximately 23–25% oxygen. By so enriching the interior kiln atmosphere during calcining of material such as petroleum coke, greater temperatures are obtained than will be obtained by the use of air alone thereby accelerating the evolution and combustion of volatile materials during calcination. The accelerated evolution and combustion of such volatiles enables the rate at which carbonaceous materials can be calcined in a kiln of a predetermined length to be increased.

11 Claims, 2 Drawing Figures

METHODS AND APPARATUS FOR CALCINING CARBONACEOUS MATERIAL

BACKGROUND OF THE INVENTION

The present invention relates to improved combustion processes and more particularly to improved methods and apparatus for calcining carbonaceous material such as petroleum coke.

Carbonaceous materials such as "green" petroleum coke are typically calcined in a rotary kiln by introducing these materials into the upper end of a slightly inclined kiln and heating the interior thereof to a temperature of approximately 2200°–2500° F. One technique for heating such a kiln is to fire an end burner disposed at the product outlet end or lower end of the kiln and directing a flame longitudinally through the kiln in the direction generally opposed to that of the product being calcined. This application of heat is effective to evolve or drive off volatile materials from the green carbonaceous material thereby increasing the density of such materials being calcined. As these gases are evolved from the green carbonaceous material, the heat within the kiln is effective to cause a combustion of such volatile gases which in turn releases heat to the kiln interior and enables the firing rate of the end burner to be reduced below a relatively high firing rate. Frequently, combustion of volatiles in the kiln will supply a majority of the heat required to calcine a green carbonaceous material such as petroleum coke. Typically, during calcination, at least 99% of the volatiles of a green carbonaceous material are evolved therefrom and are combusted as virtually complete volatilization is required in order to produce a calcined product of suitable quality. With regard to petroleum coke, calcination will typically be effective to increase the density thereof from approximately 1.6 to about 2.0 g/cm$^3$. This enables the resulting petroleum coke to be utilized for several purposes including use as a fuel.

In order to utilize the heat available in volatiles evolved during the calcining of carbonaceous material, it is known to introduce air in controlled quantities through a fan or blower mounted for revolution with the kiln itself. Such a system is illustrated in U.S. Pat. No. 2,813,822 which shows a kiln mounted blower adapted to supply controlled air flows through a plurality of tuyeres into the interior of the kiln. This forced introduction of air into the kiln is effective to improve the combustion of volatile gases evolved during the calcining of a material such as petroleum coke. More recently, it has been proposed in U.S. Pat. No. 3,888,621 to control the air supplied by a kiln mounted blower in response to interior kiln conditions. In this reference, apparatus for optically detecting smoke conditions within a kiln is provided such that the flow of air into the kiln is controlled thereby enabling an improved combustion of volatile materials while avoiding significant combustion of the carbonaceous material, i.e. petroleum coke. In addition, it is also known to adjust the residence time of a carbonaceous material in different portions of a rotary kiln so that combustion of volatile materials evolved from such carbonaceous materials may be improved. One such technique along these lines is illustrated in U.S. Pat. No. 3,966,560. Finally, it has also been proposed to optimize kiln temperatures by establishing reference temperatures at various locations of the kiln and adjusting the supply of air and kiln revolution rate, etc. in order to optimize calcination of carbonaceous materials as is described in U.S. Pat. No. 4,022,569.

Notwithstanding the foregoing improvements in processes and equipment for calcining carbonaceous material, it is frequently desirable to increase the rate at which a carbonaceous material can be adequately calcined in a rotary kiln of a predetermined size without incurring significant structural modifications and capital additions. Simply increasing the feed rate of carbonaceous material to the kiln will not result in a greater throughput of calcined material as volatiles in the material will not be volatilized sufficiently to increase density to predetermined levels. Consequently, increasing the material feed rate alone merely results in partial, incomplete volatilization which does not yield an acceptably calcined product. Increasing kiln speed alone will reduce the residence time of carbonaceous material in the kiln and will also result in incomplete volatilization and ineffective calcination. Thus, the prior art has exhibited a clear need for improving the throughput rates of rotary kilns utilized to effectively calcine carbonaceous material without extensive additional structural modifications and attendant costs.

OBJECTS OF THE INVENTION

It is an object of the present invention to provide improved methods and apparatus for calcining carbonaceous materials.

It is another object of the present invention to improve the calcination of carbonaceous materials by increasing the throughput of such materials through a rotary kiln without adversely affecting product quality.

It is still another object of the present invention to increase the throughput of rotary kilns utilized for calcining carbonaceous material without incurring extensive structural additions or significantly increasing capital costs of such apparatus.

It is an additional object of the present invention to provide methods and apparatus for efficiently increasing the temperature in a rotary kiln.

It is still a further object of the present invention to provide improved methods and apparatus for selectively enriching air supplied to a rotary kiln with oxygen during the calcination of carbonaceous material therein.

Other objects of the present invention will become apparent from the following description of exemplary embodiments thereof which follows and the novel features will be particularly pointed out in conjunction with the claims appended hereto.

SUMMARY

In accordance with the invention, apparatus for calcining carbonaceous material comprises a rotary kiln with an air fan mounted for rotation thereon and effective to introduce ambient air through an inlet thereof into the interior of the kiln, valve means disposed about a predetermined portion of the kiln circumference such that upon kiln revolution, said fan inlet and valve means are aligned for a predetermined segment of kiln revolution, a source of oxygen gas connected to said valve means and means for sensing alignment of said fan inlet with said valve means and means for opening said valve means in response to said sensing means detecting such alignment to supply oxygen gas into the fan inlet to enrich the level of oxygen in ambient air introduced into the kiln.

In accordance with the invention, the valve means described above are disposed in a stationary manner over a substantially arcuate configuration about a portion of the circumference of the rotary kiln. As the kiln rotates, suitable sensing means, such as a cam member mounted on the fan inlet is effective to actuate a switch for a period of time corresponding to the time at which the fan inlet is aligned with the outlet of a valve. During the period of such alignment, the switch is effective to cause actuation of the valve thereby opening the same and causing a flow of oxygen gas through the valve and into the fan inlet aligned with the valve outlet. Typically, a plurality of individual valves are connected to a common oxygen manifold and each of such valves is provided with a separate switch means so that individual valves are sequentilly opened during the period of time that the fan inlet is aligned with the valve outlet. As the fan inlet will exhibit a slight negative pressure and as oxygen is typically under a super-atmospheric pressure, oxygen is readily introduced into the fan inlet while such valves are open thereby enriching air drawn through said valve inlet to approximately 25% oxygen. The valve means and outlets therefor may be disposed in an arcuate configuration such that oxygen is introduced into the kiln without being forced through the bed of carbonaceous material therein and in this manner, the oxygen enriched air supplied by the fan is thoroughly mixed with the volatile gases evolved from such material thereby enabling an efficient combustion of such volatile gases. In this manner, the internal kiln temperatures may be readily raised by approximately 100°-200° F. which in turn permits a more rapid evolution of volatile materials and enables a greater volume of such volatilized materials, i.e. gases, to be combusted in a kiln of a given length. This in turn enables a greater volume of green carbonaceous material to be effectively calcined in a kiln of a predetermined length without increasing material residence time or significantly altering the kiln structure.

BRIEF DESCRIPTION OF THE DRAWING

The invention will be more clearly understood by reference to the following description of exemplary embodiments thereof in conjunction with the following drawing in which.

DESCRIPTION OF PREFERRED EMBODIMENT

Figure 1:
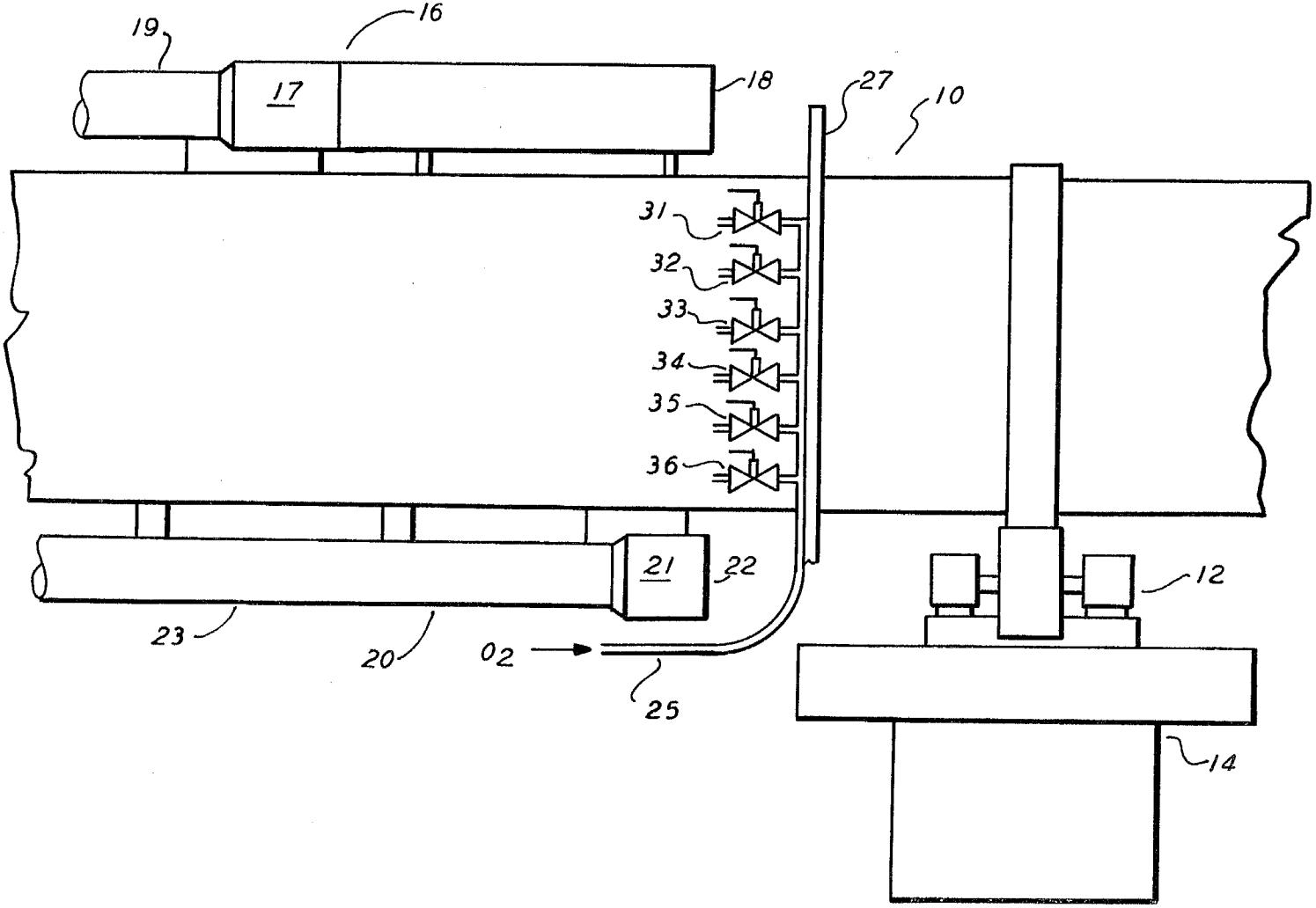
FIG. 1 shows an elevational view of a typical rotary kiln having oxygen supply means disposed therewith in accordance with the present invention.

Referring now to FIG. 1, illustrated therein is an exemplary embodiment of apparatus in accordance with the invention generally comprising a rotary kiln 10 having a fan assembly 20 mounted thereon and an oxygen supply system 25, 31–36. Rotary kiln 10 is mounted for rotation as illustrated in FIG. 1 by means of a trunion assembly 12 which is mounted on a suitable base structure 14. Mounted on kiln 10 for rotation therewith are fan assemblies 16 and 20. Each of these assemblies is preferably disposed at 180° with respect to each other on kiln 10 and assembly 16 is comprised of a fan 17, an air intake tube or duct 18 and an air outlet conduit 19. Fan assembly 20 is comprised essentially of a fan having an inlet 22 and an outlet duct 23. Outlet ducts 19 and 23 of fan assemblies 16 and 20, respectively, are connected to the interior of kiln 10 in a conventional manner such as by means of a plurality of tuyeres or other suitable devices for injecting an oxygen enriched air flow into kiln 10.

In order to enrich the air supplied to the interior of kiln 10 by fan assemblies 16 and 20, a manifold 25 is mounted on a support means 27 as is illustrated in an exemplary manner in FIG. 1. Manifold 25 and support means 27 are preferably stationary such that kiln 10 rotates with respect to this oxygen supply system. Valve means which may take the form of solenoid valves 31–36 are disposed in communication with oxygen manifold 25 and are maintained in a normally closed condition. The outlet of each of valves 31–36, i.e., the end thereof remote from manifold 25 is disposed in a generally arcuate configuration as will be more fully described in connection with the apparatus illustrated in FIG. 2 such that for prdetermined portions of each revolution of kiln 10, each of valves 31–36 will be aligned with the inlet duct 18 of fan assembly 16 or the inlet end 22 of fan 21. Typically, the diameter of the inlet duct 18 or inlet 22 of fan 21 will be considerably larger, i.e., an order of magnitude larger than the diameter of the outlet of each of valves 31–36. By establishing such relative diameters, the sensing of alignment will be facilitated and the inadvertent discharge of oxygen gas to ambient or outside inlet duct 18 or inlet 22 will be virtually eliminated.

In operation of the apparatus illustrated in FIG. 1, a charge of carbonaceous material such as petroleum coke, is introduced into rotary kiln 10 so that upon rotation thereof the charge traverses the length of this kiln in known manner. A suitable heating means such as an end fired burner (not shown) is ignited thereby heating the interior of kiln 10 to a temperature of approximately 2200°-2500° F. Fans 17 and 21 are activated so as to draw controlled quantities of air through inlet conduit 18 and inlet end 22, respectively, for supply of such air to the interior of kiln 10. Upon rotation of kiln 10, inlet conduit 18 will follow a circumferential path and for a predetermined portion of such revolution, inlet conduit 18 of fan 17 will be aligned with the outlet end of each of valves 31–36. Typically, such alignment with each valve outlet may exist over a 15° arc of each revolution of kiln 10. The alignment of inlet conduit 18 and each of valves 31–36 is sensed by a suitable alignment detection means which will be described in greater detail in connection with the apparatus illustrated in FIG. 2 and upon sensing such alignment, the solenoid of each of valves 31–36 is activated to thereby open each such valve to supply a flow of oxygen from manifold 25 into the inlet conduit 18 of fan 17. Thus, valve 31 may be the first valve to open for a predetermined portion (e.g. 15° of each revolution) such that oxygen will be supplied through valve 31 and into inlet conduit 18 along with ambient air drawn therein for the time necessary for rotation of kiln 10 to cover 15° of each such revolution. At the end of this predetermined time, the alignment sensing means associated with valve 31 (not shown in FIG. 1) will be deactivated and will thereby deactivate the solenoid associated with valve 31 closing this valve and terminating the flow of oxygen therethrough. However, the alignment detecting device provided with valve 32 will, upon closure of valve 31, be effective to indicate alignment of inlet conduit 18 with valve 32 which in turn will be open for a predetermined time interval which, as with valve 31, may correspond to about 15° of each revolution of kiln 10. In this manner, each of valves 31–36 is opened for a predetermined time interval and oxygen is then selectively supplied along with ambient air into inlet conduit 18 for introduction into kiln 10. The oxygen enriched air introduced into kiln 10 results in a temperature rise of about 100°–200° F. therein and enables a more rapid evolution of volatile materials and combustion of volatile gases during the calcining of carbonaceous material as previously described. Consequently, the rate at which such material can be calcined in a kiln of given length is increased.

Figure 2:
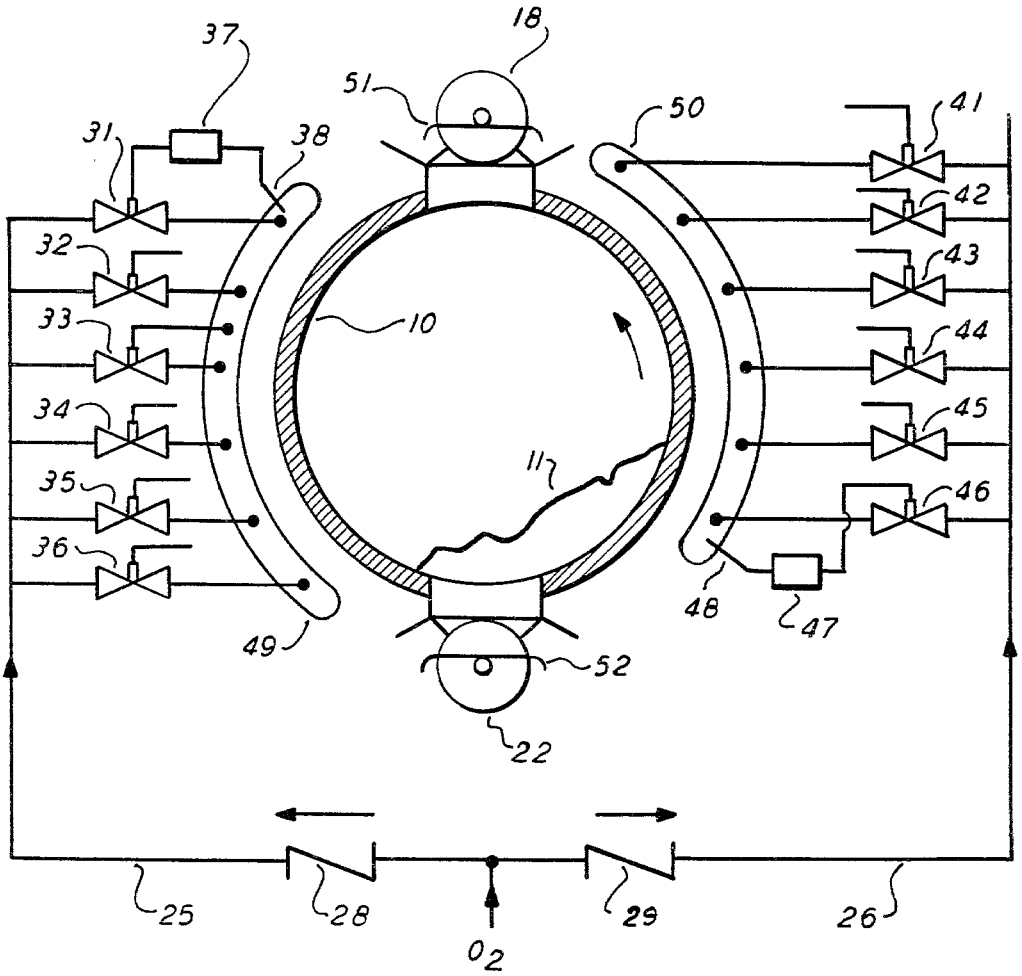
FIG. 2 is a diagrammatic view of a partial cross section of a kiln provided with oxygen supply equipment in accordance with the invention.

Referring now to FIG. 2, kiln 10 is illustrated as containing a charge of carbonaceous material such as petroleum coke and is caused to rotate in the direction of the arrow shown within kiln 10. For purposes of illustration, the end of inlet conduit 18 and the inlet of fan 22 are illustrated as mounted on kiln 10 and are thus caused to rotate therewith. Inlet conduit 18 is provided with a cam surface 51 while the inlet 22 of fan 20 (not shown) is provided with a suitable cam 52, the operation of which will be subsequently described.

Illustrated in FIG. 2 is apparatus for supplying oxygen to two sets of valves 31–36 and 41–46. Oxygen gas is supplied through check valves 28 and 29 and through manifolds 25 and 26, respectively. Manifold 25 is connected to valves 31–36 as previously described while manifold 26 is connected to valves 41–46 at the inlet of each such valve. The outlet of valves 31–36 are mounted on a stationary, arcuate support member 49 while the outlets of valves 41–46 are mounted on a similar arcuate support 50. Each of valves 31–36 and 41–46 is preferably a solenoid actuated valve and each of such valves is provided with alignment detection means which will now be discussed. A contact member 38 is electrically coupled to a limit switch 37 which in turn is connected to the solenoid of valve 31. A similar contact member 48 is connected to a similar limit switch 47, which in turn is connected to the solenoid of valve 46. It will be appreciated that each of the other valves 32–36 and 41–45 are likewise provided with similar alignment detecting structure, the operation of which will now be described.

Upon the introduction of green, carbonaceous material such as green petroleum coke into kiln 10 and the heating thereof by means of an end fired burner, etc. (not shown), kiln 10 is caused to rotate in the direction of the arrow illustrated therein. Upon this rotation, the leading edge of cams 51 and 52 engage contact members 38 and 48, respectively, and this contact is maintained during the subsequent rotation of kiln 10 through an arc corresponding to the distance along the surface of these cams. This contact defines the alignment of the outlet of a corresponding solenoid valve 31 and 46, respectively, with the inlet conduit 18 and inlet end 22 of fans 17 and 21, respectively, and this contact is effective to cause corresponding limit switches 37 and 47 to actuate the solenoids of valves 31 and 46 to open these valves and thereby supply oxygen gas therethrough. This flow of oxygen gas is then introduced into inlet conduit 18 and fan inlet 22 for a period of time during which the respective contact members 38 and 48 and cam surfaces 51 and 52 remain in contact. As mentioned previously, this predetermined time period may correspond to approximately 15° of revolution of kiln 10. Upon continued rotation of kiln 10, the contact between member 38 and cam 51 and between contact member 48 and cam 52 will be broken thereby deactivating solenoids of valves 31 and 46 to close the same and terminate the supply of oxygen therethrough. At about the same instant as valves 31 and 46 are closed, cams 51 and 52 will make contact with the appropriate contact members (not shown) associated with valves 32 and 45 thereby energizing the solenoids of these valves to cause the same to open for a predetermined portion (e.g. 15°) of a revolution of kiln 10. The remaining valves 31—34 and 41–44 are sequentially opened in the same manner as has previously been desribed in connection with valves 31, 32 and 45, 46. Accordingly, it will be appreciated that during a predetermined portion of each revolution of kiln 10, oxygen gas is introduced into the inlet of air fans 17 and 21 mounted for rotation on kiln 10 to enrich the air drawn therein in oxygen and consequently enable higher temperatures to be maintained within kiln 10. As discussed previously, the higher temperatures (approximately 100°–200° F. greater than temperatures normally established by simply introducing air into the kiln) will cause an accelerated evolution of volatile materials from the carbonaceous material and the combustion of volatile gases during the calcining of carbonaceous material 11 such that a greater volume of these will be evolved and combusted within a kiln 10 of a given length. Consequently, a greater quantity of carbonaceous material can be effectively calcined in a given kiln length or stated conversely, the speed of kiln rotation which translates into the throughput of carbonaceous material within kiln 10 may be increased significantly and still calcine such material to desired product quality, i.e. density. Typically, kiln speed will be maintained between 0.75 and 2.0 revolutions per minute. The feed rate of carbonaceous material to kiln 10 may also be increased.

It will be understood that although certain structure has been illustrated for supplying oxygen gas to the inlet of fans 17 and 21 mounted on kiln 10 for rotation therewith, other particular configurations of valves 31–36 and 41–46 may be utilized. In addition, the arcuate length essentially covered by the aforementioned valves may be varied on any given kiln in accordance with the quantity of oxygen to be supplied to such kiln to increase throughput of material to an optimized extent. While electrically operated solenoid valves are disclosed herein, it will be understood that any well known or conventional on/off type valve may be utilized. Although an arrangement of cams, contact members and limit switches are utilized to detect the alignment of a fan inlet with the outlet of a valve in an oxygen supply system, it will be understood that other alignment detecting means which may for example be optical position sensing devices, etc. may be utilized. Furthermore, reference herein to "oxygen gas" will be understood to mean substantially pure oxygen as commercially available. However, oxygen gas of lower purities, e.g. from about 50–99% may be utilized to enrich air supplied to kiln 10 in accordance with the invention. Also, the firing rate of kiln end burners may be substantially reduced upon obtaining desired calcining temperatures in kiln 10 due to the release of heat upon combustion of volatile materials therein.

The foregoing and other various changes in form and details may be made without departing from the spirit and scope of the present invention. Consequently, it is intended that the appended claims be interpreted as including all such changes and modifications.

What is claimed is:

1. Apparatus for calcining carbonaceous material comprising a rotary kiln; fan means mounted on said kiln for introducing air through an inlet thereof and into the interior of said kiln; valve means disposed about a portion of the circumference of said kiln such that upon kiln revolution, said fan inlet and valve means are aligned for a predetermined segment of kiln revolution; a source of oxygen gas connected to said valve means; means for sensing alignment of said fan inlet and said valve means; and means for opening said valve means in response to said sensing means sensing said alignment to supply oxygen gas into said fan inlet whereby air introduced into said kiln is enriched in oxygen.

2. The apparatus defined in claim 1 additionally comprising a manifold connected to said source of oxygen gas and wherein said valve means comprise a plurality of solenoid operated valves with the inlet of each of said valves being connected to said manifold.

3. The apparatus defined in claim 1 wherein said means for sensing said alignment of said fan inlet and valve means comprises limit switch means which are activated upon the leading edge of the fan inlet in the direction of kiln revolution passing said valve means and which are deactivated upon the trailing edge of said fan inlet passing said valve outlet.

4. The apparatus defined in claim 1 wherein said valve means are stationary and are disposed in a substantially arcuate configuration about the circumference of said rotary kiln.

5. The apparatus defined in claim 4 wherein said valve means comprise a plurality of solenoid operated valves disposed in said arcuate configuration and wherein said sensing means comprise a plurality of limit switches each of which is disposed to sense alignment of the fan inlet and one of said solenoid operated valves with each of said limit switches connected to the solenoid of a corresponding valve such that upon kiln rotation and alignment of said fan inlet with each of said valves said limit switches are sequentially activated to thereby open a corresponding one of said valves.

6. The apparatus defined in claim 5 additionally comprising cam means mounted on said fan means and wherein said sensing means additionally comprise a contact member associated with each limit switch such that upon contact between each contact member and cam means a corresponding one of said limit switches is activated.

7. The apparatus defined in claim 4 wherein said arcuate configuration of said valve means extends over approximately 90° of the circumference of said kiln.

8. The apparatus defined in claim 4 wherein said valve means comprise first and second sets of solenoid operated valves, each of said sets being substantially juxtaposed about the circumference of said kiln with respect to each other and each of said sets extending over approximately 90° of the circumference of said kiln.

9. The apparatus defined in claim 7 wherein said carbonaceous material is comprised of a bed of petroleum coke which extends over a predetermined lower portion of said kiln and wherein said valve means are located such that oxygen supplied therethrough is not introduced into said lower portion of said kiln through said bed of petroleum coke.

10. A method of calcining carbonaceous material comprising the steps of introducing a charge of said material into a rotary kiln; heating said kiln to a temperature of at least 2200° F.; rotating said kiln; introducing air into said kiln through one or more fans mounted on said kiln for rotation therewith; selectively opening valve means to supply oxygen gas into the inlet of said one or more fans upon alignment of said fan inlet and said valve means to thereby enrich said introduced air in oxygen and to accelerate the evolution of volatile materials from said carbonaceous materials and the combustion of said volatile materials.

11. The method defined in claim 9 wherein said valve means comprise solenoid operated valves and the step of selectively opening said valve means comprises sensing the alignment of the leading edge of the fan inlet in the direction of kiln rotation with the outlet of said valve means; generating an electrical signal upon sensing said alignment; and supplying said signal to at least one of said solenoid operated valves to open said valve to thereby supply oxygen gas therethrough and into the inlet of the fan aligned therewith.

* * * * *